US010119224B2

(12) United States Patent
Chang

(10) Patent No.: US 10,119,224 B2
(45) Date of Patent: Nov. 6, 2018

(54) METHOD FOR MANUFACTURING AN IMITATION LEATHER BANDED STRUCTURE WITH NOCTILUCENCE

(71) Applicant: Chun-Hao Chang, New Taipei (TW)

(72) Inventor: Chun-Hao Chang, New Taipei (TW)

(73) Assignee: Chun-Hao Chang, New Taipai (TW)

( * ) Notice: Subject to any disclaimer, the term of this patent is extended or adjusted under 35 U.S.C. 154(b) by 246 days.

(21) Appl. No.: 15/172,308

(22) Filed: Jun. 3, 2016

(65) Prior Publication Data

US 2017/0350068 A1 Dec. 7, 2017

(51) Int. Cl.
*D06N 3/00* (2006.01)
*D06N 3/12* (2006.01)

(52) U.S. Cl.
CPC ..... *D06N 3/0002* (2013.01); *D06N 3/0086* (2013.01); *D06N 3/12* (2013.01)

(58) Field of Classification Search
None
See application file for complete search history.

(56) References Cited

U.S. PATENT DOCUMENTS

2010/0330334 A1* 12/2010 Feng ..... D06N 3/0063 428/142
2012/0015176 A1* 1/2012 Riebel ..... B32B 27/06 428/323

FOREIGN PATENT DOCUMENTS

JP 2014181424 A * 9/2014

OTHER PUBLICATIONS

Machine Translation of JP 2014-181424 A (Year: 2018).*

* cited by examiner

*Primary Examiner* — Shamim Ahmed
*Assistant Examiner* — Bradford M Gates

(57) ABSTRACT

A method for manufacturing an imitation leather banded structure with noctilucence. The method has following steps: (1) providing an object with a surface; (2) coating a primer layer on the surface; (3) coating a shielding layer and a colored layer sequentially on the primer layer via a color printing mode; (4) coating a predetermined pattern on the colored layer; and (5) covering a transparent ink layer, and performing an imitation leather printing via a UV mask.

6 Claims, 4 Drawing Sheets

METHOD FOR MANUFACTURING AN IMITATION LEATHER BANDED STRUCTURE WITH NOCTILUCENCE

BACKGROUND OF THE INVENTION

1. Field of the Invention

The present disclosure relates to a method for manufacturing an imitation leather banded structure. In particular, it relates to a method for manufacturing an imitation leather banded structure with noctilucence.

2. Description of the Related Art

The object, such as a strap or belt, made from a leather material is usually used in our daily life. However, the object included in leather category is limited in colors when using. The reason is that if a specific pattern is printed on the leather, it is difficult to perform color printing in the conventional technology because it is limited to the leather material and its non-uniform surface.

On the other hand, even though the ink is coated onto the leather, it merely exhibits single color, such as a color illustrated by black ink or white ink, thereby making people bored. If the user hopes to produce complicated pictures, words, or lines on the leather products, it's not only difficult to put it into practice for the user, but it's also hard to generate noctilucent effect on the leather products. Even though imitation leather material is used, the aforementioned effect is very difficult to achieve in application. Therefore, when users hope to obtain an imitation leather product including noctilucent effect and complicated pictures, words, or lines, it's very difficult to produce it.

In view of this, it's necessary to offer a manufacturing method for an imitation leather banded structure to allow non leather products to not merely have visual effect like leather products, but also have noctilucent effect. This enhances the user's visual effect, solves above-mentioned problems, and improves application widely for industry

SUMMARY OF THE INVENTION

In order to improve the disadvantages of the conventional technology, the present invention illustrates a method for manufacturing an imitation leather banded structure with noctilucence.

One of the purposes for the present invention is to provide a method for manufacturing an imitation leather banded structure with noctilucence. After a predetermined pattern is printed on the surface of a non leather product, even though users use the non leather product, it has visual effect like the leather product.

Another purpose for the present invention is to provide a method for manufacturing an imitation leather banded structure with noctilucence. The non leather product does not only have visual effect, but also has self-luminous noctilucent effect. It enhances the user's viewing experience under low light source environment.

To achieve above-mentioned objective, the present invention provides a method for manufacturing an imitation leather banded structure with noctilucence, comprising: (1) providing an object with a surface; (2) coating a primer layer on the surface; (3) coating a shielding layer and a colored layer sequentially on the primer layer via a color printing mode; (4) coating a predetermined pattern on the colored layer; and (5) covering a transparent ink layer, and performing an imitation leather printing via a UV mask. Wherein the shielding layer and the colored layer partially cover the primer layer.

Preferably, the primer layer is a noctilucent layer.

Preferably, the color printing mode is a UV color printing.

Preferably, the shielding layer, the colored layer, and the transparent ink layer are a UV ink layer.

Preferably, the predetermined pattern is a colored pattern or a black-and-white pattern.

Preferably, the object is polyvinyl chloride, polyethylene terephthalate, polypropylene, or combination thereof.

Many of the attendant features and advantages of the present invention will becomes better understood with reference to the following detailed description considered in connection with the accompanying drawings.

BRIEF DESCRIPTION OF THE DRAWINGS

The detailed structure, operating principle and effects of the present invention will now be described in more details hereinafter with reference to the accompanying drawings that show various embodiments of the present invention as follows.

DETAILED DESCRIPTION OF THE PREFERRED EMBODIMENTS

Figure 1:
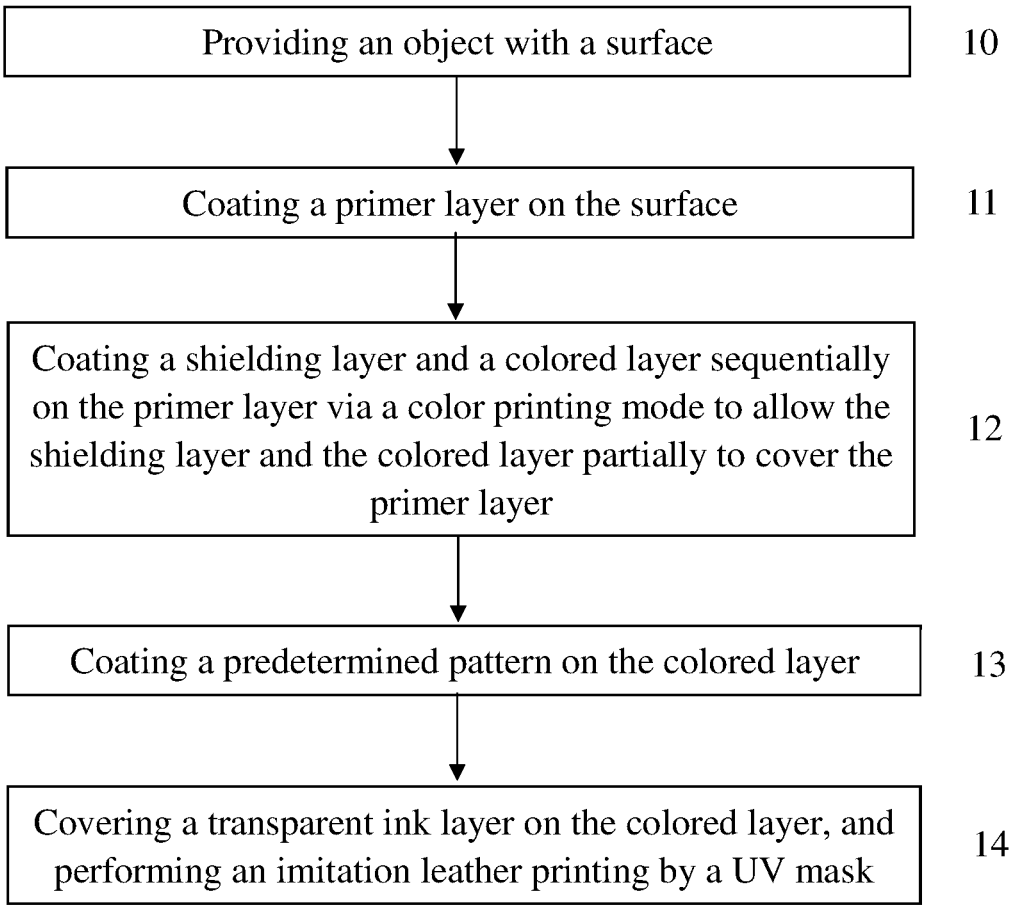
FIG. 1 a flow chart of a manufacturing method for an imitation leather banded structure with noctilucence.

Reference will now be made in detail to the exemplary embodiments of the present invention, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this invention will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

For convenience, certain terms employed in the specification, examples and appended claims are collected here.

Unless defined otherwise, all technical and scientific terms used herein have the same meaning as commonly understood by one of the ordinary skill in the art to which this invention belongs.

The singular forms "a", "and", and "the" are used herein to include plural referents unless the context clearly dictates otherwise.

The present invention relates to a method for manufacturing an imitation leather banded structure 100 with noctilucence. This method can form a pattern with noctilucent effect on the surface of non leather material, thereby satisfying the need of users purchasing the imitation leather product. The imitation leather product does not only have visual effect, but also has self-luminous noctilucent effect. It enhances the user's viewing experience under low light source environment.

Figure 2:
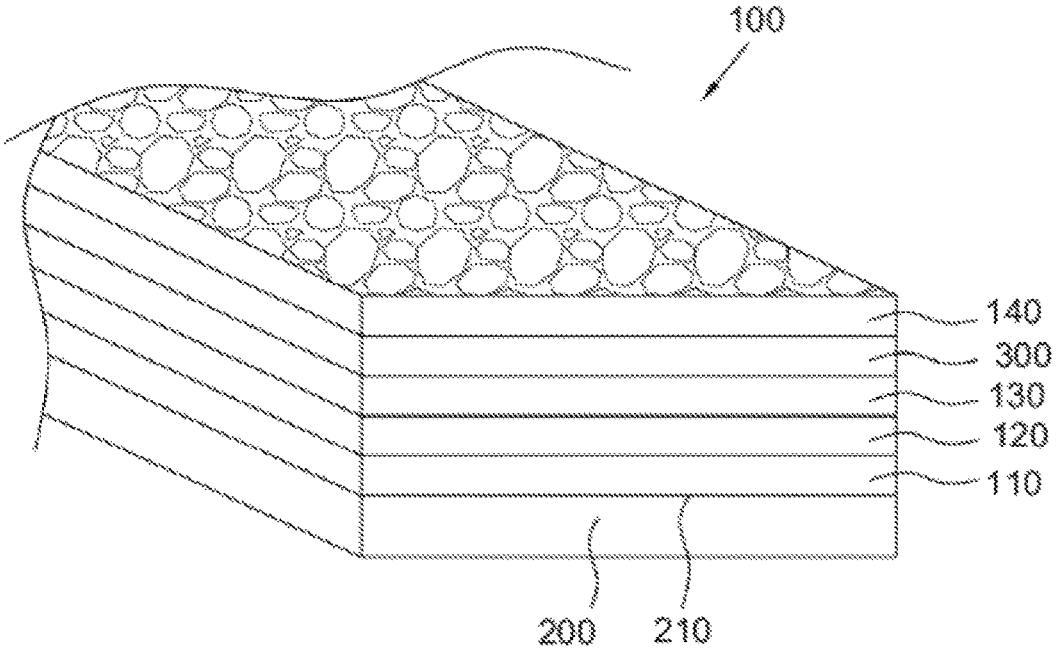
FIG. 2 is a perspective view of the imitation leather banded structure with noctilucence.

FIG. 1 is a flow chart of a manufacturing method for an imitation leather banded structure with noctilucence, and FIG. 2 is a perspective view of the imitation leather banded structure with noctilucence.

Please refer to FIG. 1, the present invention provides a method for manufacturing an imitation leather banded structure with noctilucence, comprising following steps.

At first, please refer to step 10, providing an object 200 with a surface 210. Please refer to step 11, coating a primer layer 110 on the surface 210. Please refer to step 12, coating a shielding layer 120 and a colored layer 130 sequentially on the primer layer 110 via a color printing mode to allow the shielding layer 120 and the colored layer 130 partially to cover the primer layer 110. Please refer to step 13, coating a predetermined pattern 300, such as pictures, words, lines, or combination thereof, on the colored layer 130. Eventually, covering a transparent ink layer 140 on the colored layer 130, performing an imitation leather printing by a UV mask, and producing a leather pattern on the predetermined pattern 300.

In this embodiment, the primer layer 110 is a noctilucent layer, which is capable of absorbing light and storing it as energy under the environment having light source, thereby releasing energy to radiate light in the dark environment. As a result, the primer layer 110 of the present invention radiates light in self-luminous mode in the dark environment.

Furthermore, the shielding layer 120 is distributed on the noctilucent layer (i.e. primer layer 110). It's preferably a black ink layer which partially covers the noctilucent layer. The portion that the shielding layer 120 never covers the primer layer 110 forms a specific shape (e.g. pictures, words, lines or combination thereof).

In this embodiment, the colored layer 130 is further distributed on the shielding layer 120 to allow to further color the colored layer 130. The colored layer 130 is preferably a white ink layer.

The primer layer 110 absorbs light and does not radiate noctilucence under enough light sources. The predetermined pattern 300, which is coated onto the colored layer 130, is present on the surface of the predetermined pattern for the user because of the effect of the transparent ink layer 140 of the imitation leather printing.

On the contrary, the portion that the shielding layer 120 never covers the primer layer 110 radiates light because of noctilucent effect, which has a specific shape and brings a visual effect, under low light sources. The light radiated from the primer layer 110 totally differs from the light sources, thereby bringing different view experience for the user.

Preferably, the method for color printing is a UV color printing in the present invention, and the shielding layer 120, the colored layer 130, and the transparent ink layer 140 are correspondingly a UV ink layer to achieve the effect of fast drying and printing on the surface of specific objects with the exception of papers.

On the other hand, the predetermined pattern 300 does not only comprise a single pattern used in the conventional technology, but also comprises a colored pattern performed by the UV color printing. It provides more and plentiful selections for the user.

In the preferred embodiment of the present invention, the object 200 is polyvinyl chloride (PVC), polyethylene terephthalate (PET), polypropylene, or combination thereof, such that the coloring process is performed by the UV color printing rather than conventional printing method. The method used in the present invention can not merely achieve the effect of coating the predetermined pattern 300 onto the surface 210 of the object 200, but also has the effect of presenting pictures, words, lines or combination thereof with noctilucence.

On the other hand, in an embodiment of the present invention, taking the object 200 as PVC for example, when the object 200 of the imitation leather banded structure with noctilucence attaches to the leather product 400 to increase thickness and let it be more like the real leather object, it can achieve by the following bonding process.

Figure 3:
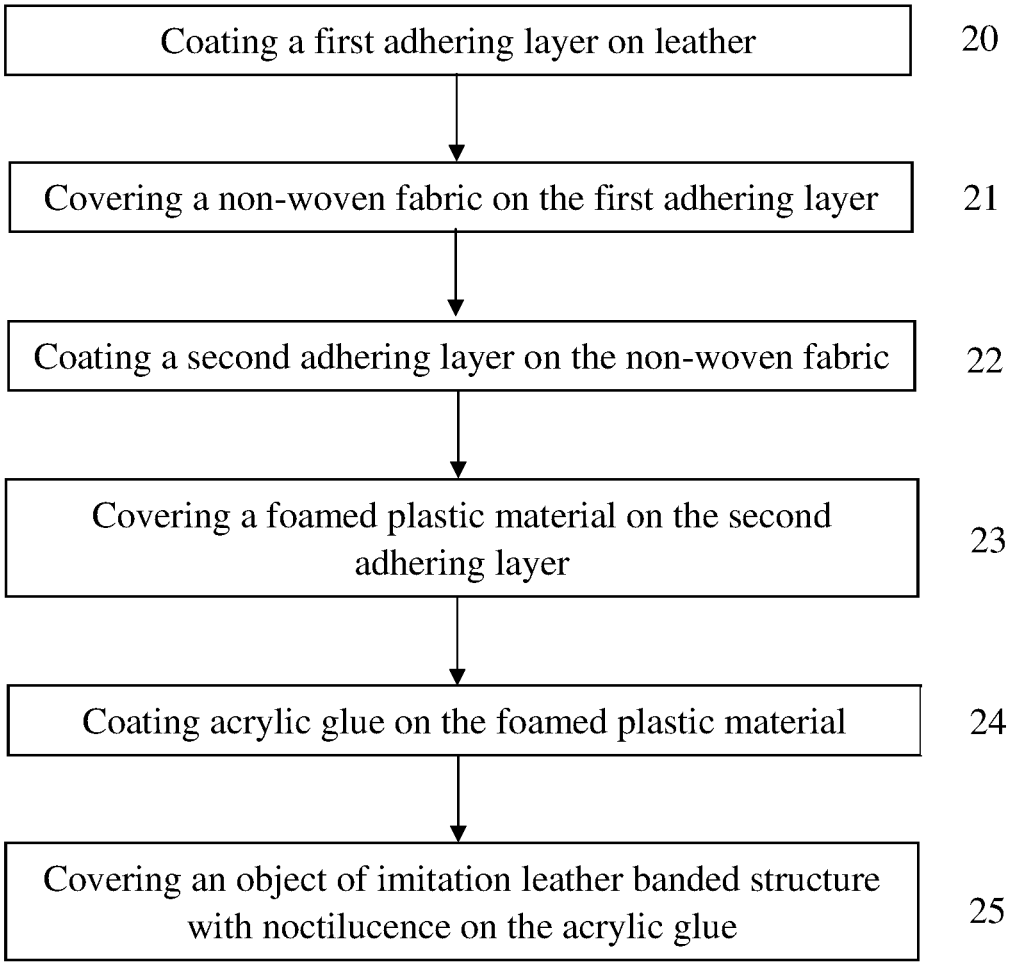
FIG. 3 is a flow chart of the imitation leather banded structure with noctilucence of the present invention attached to leather.

FIG. 3 is a flow chart of the imitation leather banded structure with noctilucence of the present invention attached to leather.

Please refer to FIG. 3, in step 20, coating a first adhering layer 410 on leather 400, and the first adhering layer 410 is preferably a bond adhesive. In step 21, covering a non-woven fabric 420 on the first adhering layer 410. In step 22, coating a second adhering layer 430 on the non-woven fabric 420, and the second adhering layer 430 is preferably a bond adhesive. In step 23, covering a foamed plastic material 440 on the second adhering layer 430. In step 24, coating acrylic glue 450 on the foamed plastic material 440. Eventually, in step 25, covering an object 200 of imitation leather banded structure 100 with noctilucence on the acrylic glue 450.

Figure 4:
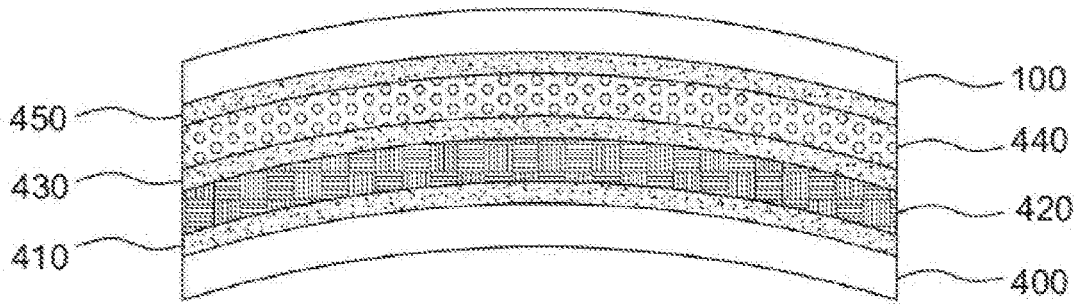
FIG. 4 is a sectional view of the imitation leather banded structure with noctilucence of the present invention attached to leather.

When completing aforementioned steps, a sectional view of the imitation leather banded structure 100 with noctilucence attached to leather 400 such as FIG. 4 is illustrated.

As a result, when the user attaches the product of the imitation leather banded structure 100 with noctilucence to leather 400, the leather 400 disposed on the most bottom layer has real tactile impression. The user can choose all kinds of patterns and print them on the imitation leather banded structure 100 with noctilucence disposed on the most top layer. It avoids that the colored pattern cannot be printed on the surface of leather in the conventional technology.

Furthermore, the non-woven fabric material is taken as a bridging layer, and adhesive degree is significantly increased by coating the first adhering layer 410, the second adhering layer 430, and the acrylic glue 450. Even though the imitation leather product is bent, an interval never exists between the object 200 of the imitation leather banded structure 100 with noctilucence and leather 400. It improves the problem that after the leather object directly adheres to the plastic material, the attachment between the leather object and the plastic material is not close and smooth, thereby causing a partial bulge when bending.

The above-mentioned descriptions represent merely the exemplary embodiment of the present invention, without any intention to limit the scope of the present disclosure thereto. Various equivalent changes, alternations or modifications based on the claims of present invention are all consequently viewed as being embraced by the scope of the present invention.

It will be understood that the above description of embodiments is given by way of example only and that various modifications may be made by those with ordinary skill in the art. The above specification, examples, and data provide a complete description of the present invention and use of exemplary embodiments of the invention. Although various embodiments of the invention have been described above with a certain degree of particularity, or with reference to one or more individual embodiments, those with ordinary skill in the art could make numerous alterations to the disclosed embodiments without departing from the spirit or scope of this invention.

What is claimed is:

1. A method for manufacturing an imitation leather banded structure, comprising:

providing an object with a surface;

coating a primer layer on the surface;

coating a shielding layer and a colored layer sequentially on the primer layer via a color printing mode to allow the shielding layer and the colored layer to partially cover the primer layer;

coating a predetermined pattern on the colored layer; and covering with a transparent ink layer, and performing an imitation leather printing via a UV mask.

2. The method as defined in claim 1, wherein the primer layer is a noctilucent layer.

3. The method as defined claim 2, wherein the color printing mode is a UV color printing.

4. The method as defined in claim 3, wherein the shielding layer, the colored layer, and the transparent ink layer are UV ink layers.

5. The method as defined in claim 4, wherein the predetermined pattern is a colored pattern or a black-and-white pattern.

6. The method as defined in claim 5, wherein the object is polyvinyl chloride, polyethylene terephthalate, polypropylene, or combinations thereof.

* * * * *